US010957463B2

(12) United States Patent
Kobayashi et al.

(10) Patent No.: US 10,957,463 B2
(45) Date of Patent: Mar. 23, 2021

(54) COVERED ELECTRICAL WIRE, TERMINAL-EQUIPPED ELECTRICAL WIRE, AND TWISTED WIRE

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Hiroyuki Kobayashi, Yokkaichi (JP); Kei Sakamoto, Osaka (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/628,538

(22) PCT Filed: Jul. 4, 2018

(86) PCT No.: PCT/JP2018/025420
§ 371 (c)(1),
(2) Date: Jan. 3, 2020

(87) PCT Pub. No.: WO2019/013074
PCT Pub. Date: Jan. 17, 2019

(65) Prior Publication Data

US 2020/0219635 A1 Jul. 9, 2020

(30) Foreign Application Priority Data

Jul. 14, 2017 (JP) ..... JP2017-138646

(51) Int. Cl.
*H01B 7/02* (2006.01)
*H01B 7/00* (2006.01)
(Continued)

(52) U.S. Cl.
CPC ..... *H01B 7/0009* (2013.01); *C22C 9/01* (2013.01); *C22C 9/02* (2013.01); *C22C 9/04* (2013.01);
(Continued)

(58) Field of Classification Search
CPC ... H01B 7/02; H01B 7/04; H01B 7/06; H01B 5/02; H01B 5/08; H01B 9/02; H01R 4/02; H01R 4/04; H01R 4/06
(Continued)

(56) References Cited

U.S. PATENT DOCUMENTS 3,131,469 A * 5/1964 Glaze ..... D07B 1/14 228/136
5,763,823 A * 6/1998 Siekierka ..... H01B 7/0009 174/113 R
(Continued)

FOREIGN PATENT DOCUMENTS

JP S52-024570 U 2/1977
JP 2005-276766 A 10/2005
(Continued)

OTHER PUBLICATIONS

Aug. 28, 2018 Search Report issued in International Patent Application No. PCT/JP2018/025420.
(Continued)

*Primary Examiner* — William H. Mayo, III
(74) *Attorney, Agent, or Firm* — Oliff PLC

(57) ABSTRACT

A covered electrical wire including a conductor and an insulating coating layer covering the outer periphery of the conductor, in which the conductor is a twisted wire obtained
(Continued)

by twisting together a plurality of elemental wires constituted by copper or a copper alloy, and the covered electrical wire includes a metallically bonded portion where the elemental wires that are adjacent to each other are metallically bonded to each other.

10 Claims, 3 Drawing Sheets

(51) Int. Cl.

| | |
|---|---|
| ***C22C 9/01*** | (2006.01) |
| ***C22C 9/02*** | (2006.01) |
| ***C22C 9/04*** | (2006.01) |
| ***C22C 9/06*** | (2006.01) |
| ***H01B 1/02*** | (2006.01) |
| ***H01B 5/08*** | (2006.01) |

(52) U.S. Cl.
CPC ..... *C22C 9/06* (2013.01); *H01B 1/026* (2013.01); *H01B 5/08* (2013.01); *H01B 7/0045* (2013.01)

(58) Field of Classification Search
USPC ... 174/110 R, 113 R, 102 R, 108, 109, 74 R, 174/77 R
See application file for complete search history.

(56) References Cited

U.S. PATENT DOCUMENTS

| | | | | |
|---|---|---|---|---|
| 2002/0062985 | A1* | 5/2002 | Rutledge ..... | H01B 11/02 174/128.1 |
| 2016/0254074 | A1* | 9/2016 | Kobayashi ..... | C22C 9/00 174/74 R |

FOREIGN PATENT DOCUMENTS

| | | | |
|---|---|---|---|
| JP | 2012-146431 | A | 8/2012 |
| JP | 2015-86452 | A | 5/2015 |

OTHER PUBLICATIONS

Jun. 26, 2019 International Preliminary Report on Patentability issued in International Patent Application No. PCT/JP2018/025420.

* cited by examiner

COVERED ELECTRICAL WIRE, TERMINAL-EQUIPPED ELECTRICAL WIRE, AND TWISTED WIRE

TECHNICAL FIELD

The present disclosure relates to a covered electrical wire, a terminal-equipped electrical wire, and a twisted wire.

The present application claims the benefit of priority based on Japanese Patent Application No. 2017-138646 filed on Jul. 14, 2017, which is incorporated herein by reference in its entirety.

BACKGROUND ART

Patent Documents 1 and 2 disclose wire harnesses used in automobiles. A wire harness is typically a bundle of terminal-equipped electrical wires that include covered electrical wires provided with insulating coating layers on the periphery of conductors thereof, and terminal portions attached to end portions of the covered electrical wires. Patent Documents 1 and 2 disclose a copper alloy twisted wire as the above-described conductor.

CITATION LIST

Patent Documents

Patent Document 1: JP 2015-086452A
Patent Document 2: JP 2012-146431A

SUMMARY OF INVENTION

A covered electrical wire according to the present disclosure is a covered electrical wire including a conductor and an insulating coating layer covering an outer periphery of the conductor, in which the conductor is a twisted wire obtained by twisting together a plurality of elemental wires constituted by copper or a copper alloy, and the covered electrical wire includes a metallically bonded portion where the elemental wires that are adjacent to each other are metallically bonded to each other.

A terminal-equipped electrical wire according to the present disclosure includes:

the covered electrical wire according to the present disclosure; and a terminal portion attached to an end portion of the covered electrical wire.

A twisted wire according to the present disclosure is a twisted wire that is to be used as a conductor of an electrical wire, in which the twisted wire is obtained by twisting together a plurality of elemental wires constituted by copper or a copper alloy, and the twisted wire includes a metallically bonded portion where the elemental wires that are adjacent to each other are metallically bonded to each other.

DESCRIPTION OF EMBODIMENTS

Figure 1:
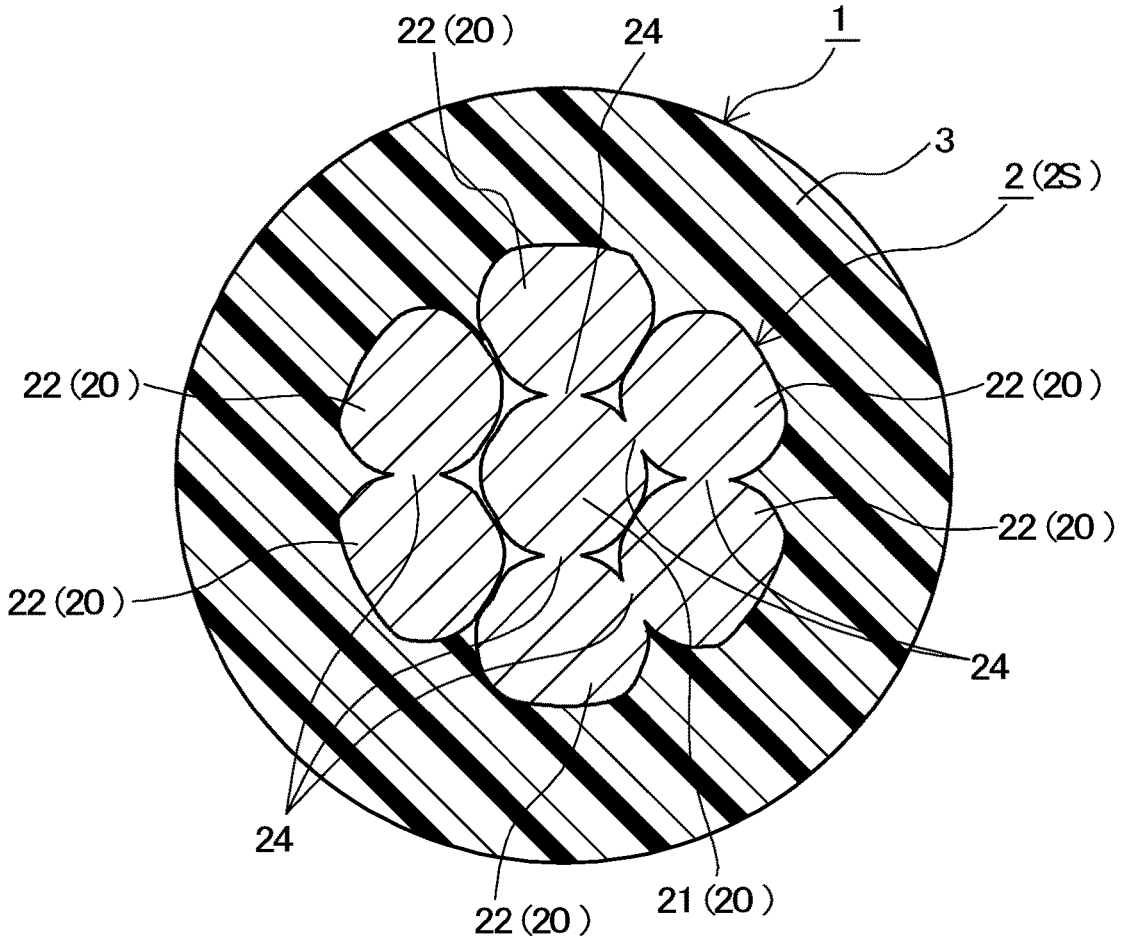
FIG. 1 is a transverse cross-sectional view schematically showing an example of a covered electrical wire according to an embodiment.

Problem to be Solved by the Present Disclosure

There is demand for a covered electrical wire that is unlikely to buckle, the covered electrical wire being used with a terminal portion attached to an end portion thereof, as the above-described terminal-equipped electrical wire provided in a wire harness.

If the cross-sectional area of a conductor is reduced (if the diameter thereof is reduced) to 0.22 $mm^2$ or less as disclosed in Patent Documents 1 and 2, even if the conductor is made of a copper alloy, the weight of the conductor can be reduced. However, if the cross-sectional area of a conductor is reduced, the rigidity of the conductor is likely to decrease, and the rigidity of a covered electrical wire is also likely to decrease. If a covered electrical wire having low rigidity is used as the above-described terminal-equipped electrical wire, there is a possibility that a portion located near a terminal portion of the covered electrical wire will locally buckle (so-called bend) when the terminal portion is inserted into a terminal housing portion of a housing, for example. Thus, from the viewpoint of improving the workability for inserting a terminal portion, there is demand for a covered electrical wire that is unlikely to buckle even if the cross-sectional area of a conductor is small. Also, if a twisted wire is used as the conductor of the covered electrical wire as disclosed in Patent Documents 1 and 2, bending or the like can be performed easily, even if rigidity is somewhat increased. Thus, there is demand for a twisted wire by which it is possible to construct a covered electrical wire that is unlikely to buckle and can be easily bent, for example.

Also, there is demand for a further reduction in contact resistance with a terminal portion of a covered electrical wire that is used with the terminal portion attached to an end portion thereof as described above, even if the degree of compression of the conductor at which the terminal portion is compressed is small.

Patent Document 1 discloses that contact resistance is low when a terminal portion is fixed through crimping to a twisted wire conductor in which the conductor has a cross-sectional area of 0.22 $mm^2$ or 0.13 $mm^2$, when the crimping height is set to 0.76. Here, it is conceivable that, when a crimp terminal is attached, if the degree of compression therefor is increased, a large area of contact between each elemental wire and the terminal portion can be easily secured by cancelling a twisted state of a twisted wire, and contact resistance is likely to decrease. However, the larger the above-described degree of compression is, the smaller the remaining area ratio of the compressed portion of the conductor where the terminal portion is compressed is (details will be described later). Thus, in the compressed portion of the conductor where the terminal portion is compressed and the vicinity thereof, a tolerable force (N) at which breakage does not occur when an impact is applied is smaller, compared to an uncompressed portion of the conductor to which no terminal portion is attached, and thus the compressed portion and the vicinity thereof prove to be a weakpoint in terms of impact resistance, for example. If the above-described degree of compression is reduced, a large remaining area ratio of the compressed portion of the conductor where the terminal portion is compressed and the vicinity thereof can be secured, good properties of an uncompressed portion thereof, for example, impact resistance, can be maintained, and thus a terminal-equipped electrical wire having good impact resistance can be obtained. Thus, there is demand for a covered electrical wire having low contact resistance and a twisted wire by which it is possible to construct a covered electrical wire having low contact resistance, even if a conductor has a small cross-sectional area as described above, and even if the above-described degree of compression is smaller, and in particular, even if the remaining area ratio of the conductor where the terminal portion is compressed exceeds 0.76.

Also, there is demand for a further increase in weld strength when a branch wire or the like is welded to a covered electrical wire that is used with a terminal portion attached to an end portion thereof as described above. Also, there is demand for a twisted wire by which it is possible to construct a covered electrical wire having higher weld strength.

In view of this, an object of the present disclosure is to provide a covered electrical wire, a terminal-equipped electrical wire, and a twisted wire that are unlikely to buckle.

Advantageous Effects of the Present Disclosure

A covered electrical wire according to the present disclosure, a terminal-equipped electrical wire according to the present disclosure, and the twisted wire according to the present disclosure are unlikely to buckle.

DESCRIPTION OF EMBODIMENTS OF THE PRESENT DISCLOSURE

First, embodiments of the present disclosure will be described below.

(1) A covered electrical wire according to an aspect of the present disclosure is a covered electrical wire including a conductor and an insulating coating layer covering an outer periphery of the conductor, in which the conductor is a twisted wire obtained by twisting together a plurality of elemental wires constituted by copper or a copper alloy, and the covered electrical wire includes a metallically bonded portion where the elemental wires that are adjacent to each other are metallically bonded to each other.

The above-described twisted wire includes a compressed twisted wire obtained through compression molding after performing twisting, in addition to an uncompressed twisted wire that is obtained by twisting together a plurality of elemental wires (copper wires or copper alloy wires here) and is not subjected to compression molding.

Although the above-described covered electrical wire includes a twisted wire as a conductor, elemental wires are unlikely to slide against each other, and a plurality of elemental wires are likely to move as a whole because the above-described covered electrical wire includes the above-described metallically bonded portion. The rigidity of the conductor is increased in this respect, and thus the above-described covered electrical wire is unlikely to buckle. Even if the conductor has a small cross-sectional area, for example, even if the conductor has a cross-sectional area of 0.22 $mm^2$ or less, 0.2 $mm^2$ or less, or 0.15 $mm^2$ or less, as described above, the covered electrical wire has good rigidity and is unlikely to buckle because the elemental wires are likely to move as a whole. If such a covered electrical wire described above is used as a terminal-equipped electrical wire, a portion located near a terminal portion is unlikely to buckle when the terminal portion is inserted into a terminal housing portion of a housing, for example, and such a covered electrical wire has good insertion workability.

Also, the above-described covered electrical wire has low contact resistance with a terminal portion even if the terminal portion is attached to an end portion of the covered electrical wire and the degree of compression of the conductor at which the terminal portion is compressed is small. This is because even if the degree of compression is reduced, contact resistance can be easily reduced because contact resistance between elemental wires can be reduced by the metallically bonded portion. Also, if the above-described degree of compression is small, the remaining area ratio of a compressed portion of the conductor where the terminal portion is compressed can be increased, and good characteristics of an uncompressed portion of the conductor can be maintained. Even if a conductor has a small cross-sectional area, in particular, even if a conductor has a cross-sectional area of 0.22 $mm^2$ or less, 0.2 $mm^2$ or less, or 0.15 $mm^2$ or less, for example, if the conductor has good impact resistance, it is possible to construct a terminal-equipped electrical wire having good impact resistance. When such a covered electrical wire described above is used as a terminal-equipped electrical wire, even if the conductor has a small cross-sectional area as described above, and even if the above-described degree of compression is reduced, the covered electrical wire has low contact resistance and good impact resistance.

Also, the above-described covered electrical wire has good weld strength when a branch wire or the like is welded to a conductor. This is because the vicinity of a portion of a twisted wire constituting the above-described conductor to which a branch wire or the like is directly welded may include a portion to which a branch wire or the like is not directly welded and where elemental wires are tightly joined by the metallically bonded portion.

(2) As one mode of the above-described covered electrical wire, the twisted wire is obtained by concentrically twisting the plurality of elemental wires, and the twisted wire includes at least one central elemental wire and a plurality of outer peripheral elemental wires covering an outer periphery of the central elemental wire, and the covered electrical wire includes a plurality of metallically bonded portions where the central elemental wire and outer peripheral elemental wires that are adjacent to the central elemental wire are metallically bonded to each other.

In the above-described mode, the central elemental wire and the outer peripheral elemental wires are tightly joined to each other by the metallically bonded portion, and thus buckling is unlikely to occur. Also, in the above-described mode, contact resistance between the central elemental wire and the outer peripheral elemental wires can be reduced by the metallically bonded portion, and thus, as described above, contact resistance with the terminal portion can be easily reduced even if the outer peripheral elemental wires and the terminal portion are mainly in direct contact with each other and the central elemental wire is not in direct contact with the terminal portion when the degree of compression of the conductor at which the terminal portion is compressed is reduced. Also, in the above-described mode, the central elemental wire and the outer peripheral elemental wires are tightly joined to each other by the metallically bonded portion, and thus the covered electrical wire has higher weld strength even if a branch wire or the like is welded thereto, and an outer peripheral elemental wire and the branch wire or the like are mainly directly welded to each other and the central elemental wire is not directly welded to the branch wire or the like.

(3) As one mode of the above-described covered electrical wire, the elemental wires are made of the copper alloy, and the copper alloy contains one or more elements selected from Fe, Ti, Mg, Sn, Ag, Ni, In, Zn, Cr, Al, and P in a total amount of 0.01 mass % to 5.5 mass % inclusive, the remaining portion including Cu and inevitable impurities.

A copper alloy having the above-described specific composition has higher strength than that of pure copper. Also, typically, the above-described copper alloy has high impact resistance when elongation is increased through heat treatment. Also, in the above-described copper alloy, the strength and electrical conductivity of a precipitation alloy can be easily increased through heat treatment such as aging, and toughness such as elongation can be easily improved. The above-described mode in which a twisted wire obtained by twisting together elemental wires made of such a copper alloy is provided as a conductor can be suitably used for wiring in a wire harness or the like for which high strength, high toughness, high impact resistance, electrical conductivity, and the like are required.

(4) A terminal-equipped electrical wire according to an aspect of the present disclosure includes the covered electrical wire according to any one of (1) to (3) above, and a terminal portion attached to an end portion of the covered electrical wire.

Because the above-described terminal-equipped electrical wire includes the above-described covered electrical wire in which the twisted wire that includes the above-described metallically bonded portion serves as a conductor, as described above, the terminal-equipped electrical wire exhibits the effects of being unlikely to buckle, having low contact resistance between the conductor and the terminal portion even if the degree of compression of a portion at which the terminal portion is attached is small, and having good weld strength.

(5) A twisted wire according to an aspect of the present disclosure is a twisted wire that is to be used as a conductor of an electrical wire, in which the twisted wire is obtained by twisting together a plurality of elemental wires constituted by copper or a copper alloy, and the twisted wire includes a metallically bonded portion where the elemental wires that are adjacent to each other are metallically bonded to each other.

Because the above-described twisted wire includes the above-described metallically bonded portion, as described above, the covered electrical wire including the twisted wire as a conductor exhibits the effects of being unlikely to buckle, having low contact resistance with the terminal portion even if the degree of compression of a portion at which the terminal portion is attached is small, and having good weld strength.

DETAILS OF EMBODIMENTS OF THE PRESENT DISCLOSURE

Hereinafter, embodiments of the present disclosure will be described in detail with reference to the drawings as appropriate. In the figures, components with the same name are denoted by the same reference numeral. In the composition of a copper alloy, the content of an element is indicated using a mass fraction (mass % or mass ppm), unless otherwise specified.

FIG. 1 is a transverse cross-sectional view obtained by cutting a covered electrical wire 1 according to an embodiment along a plane orthogonal to the axial direction thereof. Here, in order to facilitate understanding of metallically bonded portions 24, the metallically bonded portions 24 are cross-hatched, and elemental wires 20 are not hatched.

Figure 2:
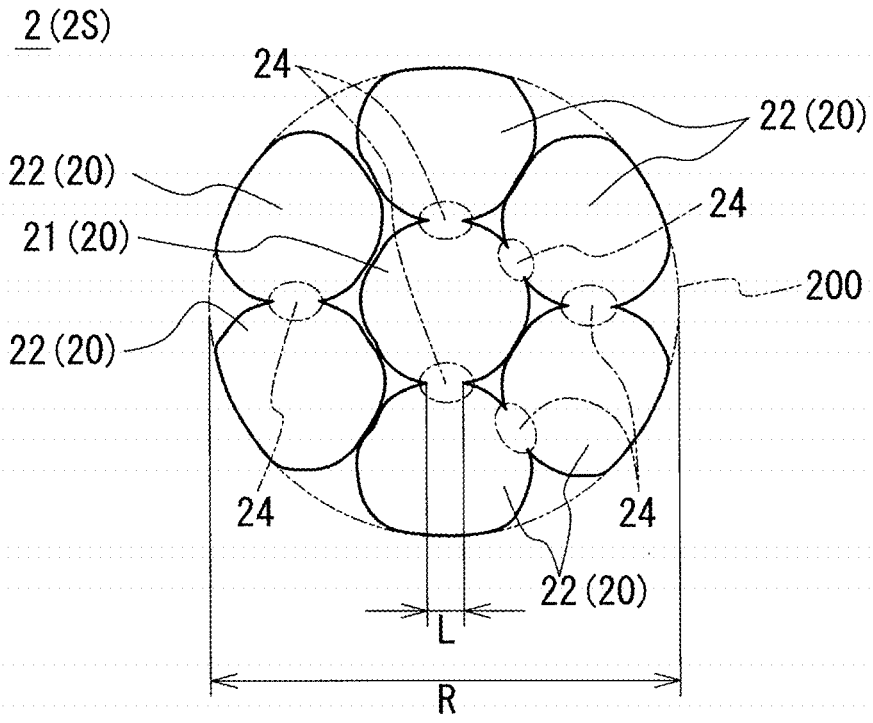
FIG. 2 is a diagram illustrating a twisted wire constituting a conductor provided in a covered electrical wire according to an embodiment.

FIG. 2 is a transverse cross-sectional view obtained by cutting a conductor 2 provided in the covered electrical wire 1 according to an embodiment along a plane orthogonal to the axial direction thereof. Here, in order to facilitate understanding of the metallically bonded portions 24, the metallically bonded portions 24 and the vicinities thereof are surrounded by one-dot chain line circles, and the elemental wires 20 are not hatched.

Covered Electrical Wire

As shown in FIG. 1, the covered electrical wire 1 according to an embodiment includes the conductor 2, and an insulating coating layer 3 covering an outer periphery of the conductor 2. The conductor 2 is a twisted wire 2S obtained by twisting together a plurality of elemental wires 20 constituted by copper or a copper alloy. The twisted wire 2S of this embodiment is used as the conductor 2 of an electrical wire such as the covered electrical wire 1, and the twisted wire 2S is obtained by twisting together a plurality of elemental wires 20 constituted by copper or a copper alloy. A representative example of the twisted wire 2S is a concentrically twisted wire obtained by concentrically twisting the plurality of elemental wires 20 as shown in FIG. 1. The concentrically twisted wire includes at least one central elemental wire 21 and a plurality of outer peripheral elemental wires 22 covering the outer periphery of the central elemental wire 21, and the outer peripheral elemental wires 22 are concentrically twisted together around the outer periphery of the central elemental wire 21. FIG. 1 shows, as an example, a compressed twisted wire obtained through compression molding, which is a 7-elemental wire concentrically twisted wire where six outer peripheral elemental wires 22 are twisted around the outer periphery of one central elemental wire 21. An example of another twisted wire 2S is a collective twisted wire (not shown) obtained by collectively twisting together a plurality of elemental wires 20. The twisted wire 2S constituting the conductor 2 provided in the covered electrical wire 1 of this embodiment and the twisted wire 2S of this embodiment include the metallically bonded portions 24 where adjacent elemental wires 20 and 20 are metallically bonded (also see the microphotograph shown in FIG. 4). Hereinafter, the twisted wire 2S constituting the conductor 2, and the insulating coating layer 3 will be described in the stated order.

Conductor

The elemental wires 20 that constitute the twisted wire 2S are each a wire made of copper (so-called pure copper) or a wire made of a copper alloy that includes additive elements, the remaining portion including Cu and inevitable impurities.

The Cu content of pure copper is 99.95% or more, for example.

The copper alloy contains one or more elements selected from Fe, Ti, Mg, Sn, Ag, Ni, In, Zn, Cr, Al, and P in a total amount of 0.01% to 5.5% inclusive, the remaining portion including Cu and inevitable impurities, for example. Such a copper alloy has higher strength than pure copper and has better impact resistance as well due to elongation being increased through heat treatment, and in the case of a precipitation alloy, the strength and electrical conductivity can be easily increased through aging, and toughness is also easily improved. The higher the total content of additive elements is, the higher the tensile strength tends to be and thus the higher the strength and the rigidity are, and the lower the total content of additive elements is, the higher the electrical conductivity tends to be, although this feature depends on the type of additive element. Specific examples of the composition are as follows (the remaining portion includes Cu and inevitable impurities).

Composition (1 precipitation+solid-solution alloy) contains Fe in an amount of 0.2% to 2.5% inclusive, Ti in an amount of 0.01% to 1.0% inclusive, and one or more elements selected from Mg, Sn, Ag, Ni, In, Zn, Cr, Al, and P in a total amount of 0.01% to 2.0% inclusive.

Composition (2 precipitation+solid-solution alloy) contains Fe in an amount of 0.1% to 1.6% inclusive, P in an amount of 0.05% to 0.7% inclusive, and at least one of Sn and Mg in a total amount of 0% to 0.7% inclusive.

Composition (3 solid-solution alloy) contains Sn in an amount of 0.15% to 0.7% inclusive.

Composition (4 solid-solution alloy) contains Mg in an amount of 0.01% to 1.0% inclusive.

In the composition (1), the Fe content may be 0.4% to 2.0% inclusive, and 0.5% to 1.5% inclusive, the Ti content may be 0.1% to 0.7% inclusive, and 0.1% to 0.5% inclusive, the Mg content may be 0.01% to 0.5% inclusive, and 0.01% to 0.2% inclusive, the Sn content may be 0.01% to 0.7% inclusive, and 0.01% to 0.3% inclusive, the Ag content may be 0.01% to 1.0% inclusive, and 0.01% to 0.2% inclusive, and the total content of Ni, In, Zn, Cr, Al, and P may be 0.01% to 0.3% inclusive, and 0.01% to 0.2% inclusive.

In the composition (2), the Fe content may be 0.2% to 1.5% inclusive, and 0.3% to 1.2% inclusive, the P content may be 0.1% to 0.6% inclusive, and 0.11% to 0.5% inclusive, the Mg content may be 0.01% to 0.5% inclusive, and 0.02% to 0.4% inclusive, and the Sn content may be 0.05% to 0.6% inclusive, and 0.1% to 0.5% inclusive.

In the composition (3), the Sn content may be 0.15% to 0.5% inclusive, and 0.15% to 0.4% inclusive.

In the composition (4), the Mg content may be 0.02% to 0.5% inclusive, and 0.03% to 0.4% inclusive.

In addition, the alloy may contain one or more elements selected from C, Si, and Mn in a total amount of 10 ppm to 500 ppm inclusive. These elements may function as an antioxidant for elements such as Fe and Sn described above.

Structure

In the case of a precipitation copper alloy (e.g., the above-described compositions (1) and (2)) in which the copper alloy constituting the elemental wires 20 forms precipitates when aging is performed, if aging is performed, the precipitation copper alloy typically has a structure including precipitates. When the copper alloy has a structure in which precipitates are evenly dispersed, higher strength resulting from precipitation strengthening, and higher electrical conductivity resulting from a decrease in the solid-solution amount of additive elements can be expected, for example.

Cross-Sectional Area

The cross-sectional area of the conductor, that is, the total cross-sectional area of the elemental wires 20 constituting the twisted wire 2S, can be selected as appropriate according to the application of the covered electrical wire 1. In particular, when the above-described cross-sectional area thereof is 0.22 $mm^2$ or less, a lightweight covered electrical wire 1 can be obtained. Such a covered electrical wire 1 can be suitably used for applications in which a reduction in weight is desired, such as a wire harness for an automobile, for example. Considering a further reduction in weight, the above-described cross-sectional area may be 0.2 $mm^2$ or less, 0.15 $mm^2$ or less, and 0.13 $mm^2$ or less.

It is preferable to select the cross-sectional area, the shape, and the like of each pre-twisting elemental wire 20, such that the cross-sectional area of the conductor has a predetermined size. Although the pre-twisting elemental wires 20 may include elemental wires 20 having different cross-sectional areas and shapes, if the elemental wires 20 have the same cross-sectional area and the same shape, twisting conditions can be easily adjusted.

Number of Elemental Wires

The number of elemental wires of the twisted wire 2S can be selected as appropriate. Examples of the number of elemental wires in a concentrically twisted wire include 7, 19, and 37. In the 7-elemental wire concentrically twisted wire shown in FIG. 1, the outer periphery of one central elemental wire 21 is provided with one outer peripheral layer constituted by six outer peripheral elemental wires 22. A 19-elemental wire twisted wire includes two outer peripheral layers, and a 37-elemental wire twisted wire includes three outer peripheral layers. In addition, two or more wires can be used as the central elemental wire 21 in a concentrically twisted wire.

Shape

The outer shape of the twisted wire 2S (the conductor 2) is a shape corresponding to the twisted state. Typical examples of a compressed twisted wire include twisted wires whose transverse cross-sectional shape or end surface shape is similar to a circle (see FIG. 1). In addition, as a result of appropriately selecting the shape of a mold used in compression molding, the transverse cross-sectional shape thereof may be an elliptical shape or a polygonal shape such as a hexagonal shape, for example.

A compressed twisted wire is likely to have a portion where adjacent elemental wires 20 and 20 are in surface contact with each other, depending on the degree of compression. Thus, if the twisted wire 2S is a compressed twisted wire, it is expected that the twisted wire 2S is likely to include a larger number of metallically bonded portions 24 or include metallically bonded portions 24 having a longer bond length L (FIG. 2).

Metallically Bonded Portion

The twisted wire 2S constituting the conductor 2 provided in the covered electrical wire 1 of this embodiment and the twisted wire 2S of this embodiment each have at least one transverse cross-section where a metallically bonded portion 24 is present. FIG. 2 is a diagram schematically showing a transverse cross-section of the twisted wire 2S where the metallically bonded portions 24 are present. The metallically bonded portions 24 are formed through metallic bonding of Cu, which is the main component of adjacent elemental wires 20 and 20 among the elemental wires 20 constituting the twisted wire 2S. Adjacent elemental wires 20 and 20 are tightly joined by the metallically bonded portions 24, and the twisted wire 2S is unlikely to come apart. Thus, the twisted wire 2S provided with the metallically bonded portions 24 is unlikely to buckle because the rigidity thereof is increased, and can be easily bent, for example. Also, with the twisted wire 2S having the metallically bonded portions 24, contact resistance between elemental wires 20 can be reduced. Also, when a branch wire or the like is welded to a portion of the twisted wire 2S, and a metallically bonded portion 24 that is not directly welded to the branch wire or the like is present near a portion of the twisted wire 2S that is directly welded to the branch wire or the like, weld strength is increased. Thus, it is possible to construct the covered electrical wire 1 that is unlikely to buckle, can be easily bent, has low contact resistance between elemental wires 20, and has good weld strength, for example, due to the twisted wire 2S having the metallically bonded portions 24 being included as the conductor 2.

The metallically bonded portions 24 can be confirmed through simple observation of a transverse cross-section of the covered electrical wire 1 or the twisted wire 2S using a microscope such as an optical microscope or a metallographical microscope. In an observation image obtained using the microscope or a processed image that has been subjected to image processing as appropriate, a portion where adjacent elemental wires 20 and 20 are in contact with each other, that is, a region in which the boundary between adjacent elemental wires 20 and 20 cannot be visually identified, can be regarded as a metallically bonded portion 24 (also see FIG. 4). More precisely, metallically bonded portions are extracted by polishing the cross-section using a cross-section polisher (CP), and observing the resulting cross-section using a scanning electron microscope (SEM), for example. Also, in a state in which only the twisted wire 2S is present, when the twisted wire 2S is untwisted using hands or the like to open twists, portions at which elemental wires 20 and 20 are joined to each other so as not to be untwisted can be easily found. More simply, this joined portion can be regarded as a metallically bonded portion 24. It is expected that if a transverse cross-section of this joined portion or the vicinity thereof is obtained, the metallically bonded portions 24 can be efficiently extracted.

When the covered electrical wire 1 or the twisted wire 2S is viewed in the axial direction, the higher the number of transverse cross-sections where the above-described metallically bonded portions 24 are present is, the easier it is to obtain the effects of being able to increase the rigidity of the twisted wire 2S, being able to reduce contact resistance between elemental wires 20, and being able to increase weld strength. If a coil member in which the covered electrical wire 1 or the like is wound on a reel is used, for example, the covered electrical wire 1 or the twisted wire 2S may include, for every 3 m thereof, one or more transverse cross-sections where the above-described metallically bonded portions 24 are present. It is preferable that the covered electrical wire 1 or the twisted wire 2S includes one or more transverse cross-sections where the metallically bonded portions 24 are present, at an interval of 2% to 20% inclusive with respect to the length of the covered electrical wire 1 or the twisted wire 2S. In short, when the covered electrical wire 1 or the twisted wire 2S is viewed in the axial direction, the covered electrical wire 1 or the twisted wire 2S includes the metallically bonded portions 24 at a plurality of different locations. Alternatively, if the covered electrical wire 1 is provided in a wire harness or the like, and the length thereof is relatively short, for example, the covered electrical wire 1 has a length of about 0.5 m to 5 m inclusive, the covered electrical wire 1 includes one or more transverse cross-sections where the metallically bonded portions 24 are present. In particular, it is preferable that the metallically bonded portions 24 are present in the vicinity of a portion at which the terminal portion is attached, because buckling is unlikely to occur in the vicinity of the terminal portion of the covered electrical wire 1 when the terminal portion is inserted into a terminal housing portion of a housing.

The higher the number of metallically bonded portions 24 described above is in one transverse cross-section obtained from the covered electrical wire 1 or the twisted wire 2S, the easier it is to obtain the effects of being able to increase the rigidity of the twisted wire 2S, being able to reduce contact resistance between elemental wires 20, and being able to increase weld strength. That is, in the twisted wire 2S, at least one of the sets of adjacent elemental wires 20 and 20 includes the metallically bonded portion 24, and if the majority of the sets, in particular, all of the sets, include the metallically bonded portions 24, the above-described effects can be easily obtained. A plurality of metallically bonded portions 24 need not be present in one transverse cross-section, and when the covered electrical wire 1 or the twisted wire 2S is viewed in the axial direction, a plurality of the above-described sets of adjacent elemental wires 20 and 20 preferably include the metallically bonded portions 24. Even if the number of metallically bonded portions 24 in one transverse cross-section is large, if a plurality of metallically bonded portions 24 are present apart from each other when the covered electrical wire 1 is viewed in the axial direction, bending or the like can be easily performed. Examples of the set of adjacent elemental wires 20 and 20 include sets of the central elemental wire 21 and outer peripheral elemental wires 22 and sets of adjacent outer peripheral elemental wires 22 and 22 if the twisted wire 2S is a concentrically twisted wire shown in FIGS. 1 and 2 and includes one central elemental wire 21 and one outer peripheral layer. In this example, six sets of adjacent elemental wires 20 and 20 in total include metallically bonded portions 24. In the case of a concentrically twisted wire including a plurality of central elemental wires 21, another example of the set of adjacent elemental wires 20 and 20 is a set of adjacent central elemental wires 21 and 21. In the case of a concentrically twisted wire including a plurality of outer peripheral layers, examples thereof include sets of adjacent outer peripheral elemental wires 22 and 22 in the same outer peripheral layer, and sets of outer peripheral elemental wires 22 and 22 that are adjacent to each other in different outer peripheral layers.

In one transverse cross-section obtained from the covered electrical wire 1 or the twisted wire 2S, the metallically bonded portion 24 preferably has a mode of including one or more portions where, out of the elemental wires 20 constituting the twisted wire 2S, an elemental wire 20 disposed on the inner side and an elemental wire 20 disposed on the outer side are metallically bonded to each other, and more preferably has a mode of including a plurality of such portions. In this mode, elemental wires 20 are tightly joined to each other and buckling is unlikely to occur, and for example, when the terminal portion is attached to the twisted wire 2S with a relatively small degree of compression, even if an inner elemental wire 20 such as the central elemental wire 21 is not in direct contact with the terminal portion, and only outer elemental wires 20 such as the outer peripheral elemental wires 22 substantially are in contact with the terminal portion, contact resistance with the terminal portion is likely to decrease. Also, when a branch wire or the like is welded to the twisted wire 2S, for example, even if the branch wire or the like is not in direct contact with an inner elemental wire 20 such as the central elemental wire 21, and the branch wire or the like substantially is welded to only outer elemental wires 20 such as the outer peripheral elemental wires 22, weld strength is likely to increase. Thus, it is possible to construct the covered electrical wire 1 that is unlikely to buckle, has low contact resistance with the terminal portion even if the degree of compression is small, and has good weld strength due to including the twisted wire 2S having this mode.

In particular, a concentrically twisted wire preferably includes two or more metallically bonded portions 24 where the central elemental wire 21 and outer peripheral elemental wires 22 are metallically bonded, and two or more metallically bonded portions 24 where adjacent outer peripheral elemental wires 22 and 22 are metallically bonded, because buckling is less likely to occur, contact resistance with the terminal portion is likely to decrease even if the degree of compression is low, and weld strength is likely to increase. FIGS. 1 and 2 show, as an example, a case where there are a plurality (three here) of metallically bonded portions 24 where the central elemental wire 21 and outer peripheral elemental wires 22 that are adjacent to the central elemental wire 21 are metallically bonded to each other, and a plurality (three here) of metallically bonded portions 24 where adjacent outer peripheral elemental wires 22 and 22 are metallically bonded to each other. Also, all of the elemental wires 20 constituting the twisted wire 2S are suitably joined to each other via any of the metallically bonded portions 24 in the sets of adjacent elemental wires 20 and 20. In the example shown in FIG. 1, if one of the two outer peripheral elemental wires 22 and 22 located on the left side of the drawing includes a metallically bonded portion 24 that is metallically bonded to the central elemental wire 20, for example, all of the seven elemental wires 20 are joined to each other via the metallically bonded portions 24.

The metallically bonded portions 24 present in one transverse cross-section obtained from the covered electrical wire 1 or the twisted wire 2S are regarded as regions in which the boundary between elemental wires 20 and 20 that are adjacent to each other in the above-described manner cannot be visually identified, and the minimum distance of this region is indicated by a bond length L. The longer each bond length L is, and the longer the total length of the bond lengths L is, the more tightly the elemental wires 20 are joined by the metallically bonded portions 24, the higher the rigidity is, the further the contact resistance between elemental wires 20 can be reduced, and the more likely the above-described weld strength is to increase. When the conductor has a cross-sectional area of about 0.1 $mm^2$ to 0.22 $mm^2$ inclusive, if the total length of the bond lengths L is 0.05 mm or more, 0.06 mm or more, or 0.08 mm or more, as described above, it is possible to easily obtain effects such as an increase in rigidity, a reduction in contact resistance between elemental wires 20, and an increase in weld strength. Alternatively, when the total length of the bond lengths L is about 3% to 15% inclusive, and about 5% to 10% inclusive of a diameter R of the smallest envelope circle 200 that includes the twisted wire 2S, it is possible to easily obtain the above-described effects such as an increase in rigidity, a reduction in contact resistance between elemental wires 20, and an increase in weld strength, and a decrease in flexibility of the twisted wire 2S can be easily suppressed.

As described above, if a plurality of the metallically bonded portions 24 where the central elemental wire 21 and the outer peripheral elemental wires 22 are metallically bonded are present, and a plurality of the metallically bonded portions 24 where adjacent outer peripheral elemental wires 22 and 22 are metallically bonded are present, it is preferable that the total length of the bond lengths L of the metallically bonded portions 24 where the central elemental wire 21 and outer peripheral elemental wires 22 are metallically bonded is 0.05 mm or more, and the total length of the bond lengths L of the metallically bonded portions 24 where outer peripheral elemental wires 22 and 22 are metallically bonded is 0.05 mm or more, because it is possible to easily obtain the above-described effects such as an increase in rigidity, a reduction in contact resistance between elemental wires 20, and an increase in weld strength.

Characteristics

Depending on the composition of each elemental wire 20 and the conditions under which the twisted wire S is manufactured, if each elemental wire 20 is made of any one of the copper alloys having the above-described compositions (1) to (4), the conductor 2 (the twisted wire 2S) may have at least one of a tensile strength of 450 MPa or more, a breaking elongation of 5% or more, and an electrical conductivity of 55% IACS or more. When the conductor 2 (the twisted wire 2S) has a tensile strength of 450 MPa or more, the conductor 2 (the twisted wire 2S) has high strength, is unlikely to buckle, and has good weld strength. When the conductor 2 (the twisted wire 2S) has a breaking elongation of 5% or more, the conductor 2 (the twisted wire 2S) can be easily bent. When the conductor 2 (the twisted wire 2S) has an electrical conductivity of 55% IACS or more, the conductivity is good, and the cross-sectional area thereof can be more easily reduced. In particular, it is preferable that the conductor 2 (the twisted wire 2S) has a tensile strength of 450 MPa or more and has a breaking elongation of 5% or more, because the conductor 2 (the twisted wire 2S) has high strength and toughness, and has better impact resistance. It is more preferable that all three listed items are satisfied. If each elemental wire 20 is made of pure copper, the conductor 2 (the twisted wire 2S) may have at least one of a tensile strength of 220 MPa or more, a breaking elongation of 15% or more, and an electrical conductivity of 98% IACS or more.

Typically, tensile strength, breaking elongation, and electrical conductivity can be set to predetermined values by adjusting the composition and manufacturing conditions of a copper alloy. If elemental wires 20 having a smaller diameter are used at a higher wiredrawing degree, or the amount of an additive element is increased when the elemental wires are made of a copper alloy, for example, the tensile strength is likely to increase and electrical conductivity is likely to decrease. If the heat treatment temperature is increased when heat treatment is performed, for example, the breaking elongation is likely to increase and the tensile strength is likely to decrease. If the elemental wires are made of a precipitation copper alloy and aging is performed, the electrical conductivity is likely to increase.

Insulating Coating Layer

Constituent Material

Examples of an insulating material constituting the insulating coating layer 3 include materials having good flame retardancy, such as polyvinyl chloride (PVC) and halogen-free resins (e.g., polypropylene (PP)). PVC is relatively soft, and it is possible to obtain a covered electrical wire 1 that can be easily bent. A halogen-free resin is relatively hard, and it is possible to obtain a covered electrical wire 1 that is unlikely to buckle even if the insulating coating layer 3 is relatively thin. A known insulating material can be used as the above-described insulating material.

Thickness

The thickness of the insulating coating layer 3 can be selected as appropriate according to the cross-sectional area of the conductor or the like, as long as the insulating coating layer 3 has a predetermined insulating strength. In particular, if the conductor 2 has a cross-sectional area of 0.22 $mm^2$ or less, the insulating coating layer 3 preferably has an average thickness of 0.21 mm or more, has an average thickness of 0.22 mm or more, and more preferably has an average thickness of 0.23 mm or more. This is because a thick insulating coating layer 3 makes it possible to improve the rigidity of the covered electrical wire 1, thus making the covered electrical wire 1 less likely to buckle. The average thickness here refers to the average of the minimum distances between the outer circumferential surface of the insulating coating layer 3 and a crown portion, excluding a twisting groove formed at a portion where outer circumferential surfaces of adjacent outer peripheral elemental wires 22 and 22 face each other, of outer circumferential surfaces of the elemental wires (the outer peripheral elemental wires 22 in FIG. 1) that are disposed on the outermost side of the conductor 2. Simply, the above-described average thickness corresponds to an average distance between the smallest envelope circle 200 (FIG. 2) that includes the conductor 2 and the outer circumferential surface of the insulating coating layer 3. The insulating coating layer 3 is preferably formed on the conductor 2 at an even thickness. This is because integration of the conductor 2 and the insulating coating layer 3 makes it possible to easily increase rigidity and makes the conductor 2 less likely to buckle.

Applications

The covered electrical wire 1 according to this embodiment can be used for various types of wiring. In particular, the covered electrical wire 1 is suitable for applications used in a state in which a terminal portion is attached to an end portion of the covered electrical wire 1. Specifically, the covered electrical wire 1 can be used for wiring in various electrical devices such as devices of automobiles and airplanes etc., and control devices of industrial robots etc., for example, wiring in various wire harnesses such as wire harnesses for automobiles. The twisted wire 2S according to this embodiment can be used as the conductor 2 of various types of wiring of the covered electrical wire 1 according to this embodiment or the like.

Terminal-Equipped Electrical Wire

Figure 3:
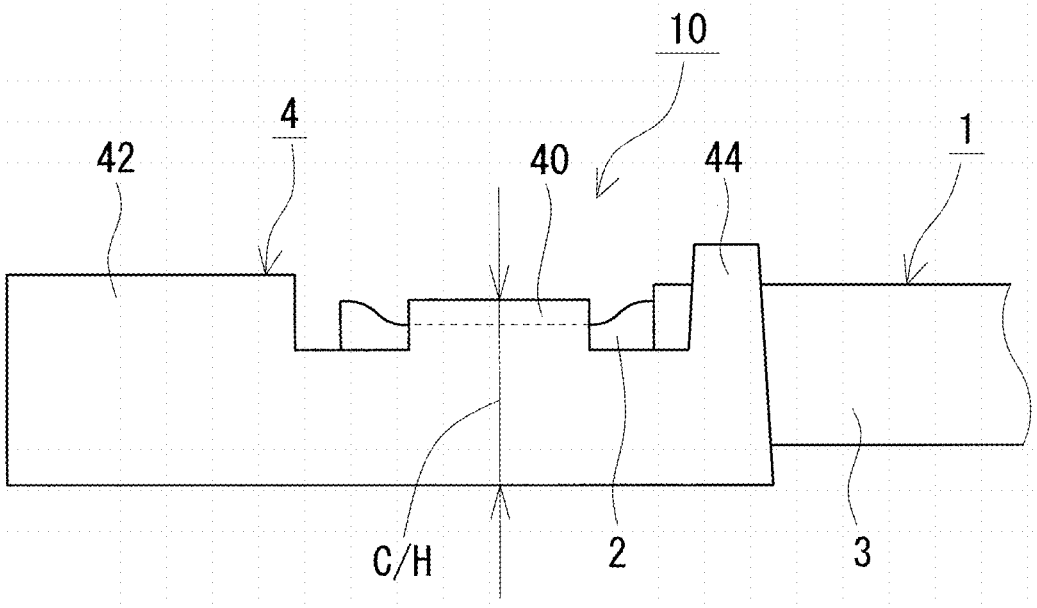
FIG. 3 is a schematic side view showing the vicinity of a terminal portion, with regard to a terminal-equipped electrical wire according to an embodiment.

As shown in FIG. 3, the terminal-equipped electrical wire 10 of this embodiment includes the covered electrical wire 1 of this embodiment, and a terminal portion 4 attached to an end portion of the covered electrical wire 1. FIG. 3 shows a crimp terminal as an example, the crimp terminal including, as the terminal portion 4, a female or male fitting portion 42 at one end thereof, an insulation barrel portion 44 for holding the insulating coating layer 3 at the other end thereof, and a wire barrel portion 40 for holding the conductor 2 at an intermediate portion thereof. The crimp terminal is crimped to the end portion of the conductor 2 that is exposed by removing the insulating coating layer 3 at the end portion of the covered electrical wire 1, and is electrically and mechanically connected to the conductor 2. Another example of the terminal portion 4 is a melting type that is connected thereto by melting the conductor 2.

Examples of a mode of the terminal-equipped electrical wire 10 include a mode in which one terminal portion 4 is attached to each covered electrical wire 1 (FIG. 3) and a mode in which a plurality of covered electrical wires 1 include one terminal portion 4. If a plurality of covered electrical wires 1 are bundled using a binding tool or the like, the terminal-equipped electrical wire 10 can be handled with ease.

If the terminal portion 4 to be provided in the terminal-equipped electrical wire 10 is a crimp terminal, when the ratio of the cross-sectional area of a compressed portion of the conductor 2 to which the terminal portion 4 is attached to the cross-sectional area of an uncompressed portion of the conductor 2 to which the terminal portion 4 is not attached is a remaining area ratio, and the remaining area ratio is high, the terminal-equipped electrical wire 10 has better characteristics such as impact resistance, even if the cross-sectional area of the conductor 2 is small as described above. Quantitatively, the above-described remaining area ratio may exceed 0.76. The higher the remaining area ratio is, the more the compressed portion of the conductor 2 where the terminal portion 4 is compressed is likely to maintain the good characteristics of the uncompressed portion of the conductor 2, and the terminal-equipped electrical wire 10 has better impact resistance overall. Considering an improvement in impact resistance and the like, the above-described remaining area ratio may be 0.77 or more, 0.78 or more, 0.79 or more, and 0.80 or more.

The above-described remaining area ratio satisfies the above-described range as a result of adjusting the degree of compression applied when attaching the terminal portion 4, in particular, reducing the degree of compression, and, typically, adjusting the crimp height (C/H, the height of the wire barrel portion 40 in the terminal-equipped electrical wire 10). Since the terminal-equipped electrical wire 10 of this embodiment includes, as a constituent element, the covered electrical wire 1 of this embodiment in which the twisted wire 2S of this embodiment is used as the conductor 2, even if the degree of compression is small as described above, contact resistance between the conductor 2 and the terminal portion 4 can be reduced (see test examples, which will be described later).

The uncompressed portion of the conductor 2 in the terminal-equipped electrical wire 10 of this embodiment maintains the specifications (the composition, structure, twisted state, shape, characteristics, and the like) of the conductor 2 provided in the covered electrical wire 1 of the above-described embodiment, or has characteristics and the like that are substantially equal thereto. Details thereof are as described above.

Applications

The terminal-equipped electrical wire 10 of this embodiment can be used for the above-described wiring in various electrical devices such as devices of automobiles and airplanes, and control devices, and in particular, wiring in various wire harnesses such as wire harnesses for automobiles.

Wire Welding Structure

In the covered electrical wire 1 of this embodiment and the terminal-equipped electrical wire 10 of this embodiment, a branch can be formed by welding a branch wire or the like to a portion of the conductor 2. In this case, the conductor 2 may have a state where a branch wire or the like is directly welded to at least one of the elemental wires 20 constituting the twisted wire 2S, typically, an elemental wire 20 disposed on the outer side, and the branch wire or the like is not directly welded to another elemental wire 20, typically, an elemental wire 20 disposed on the inner side, or an outer elemental wire 20 disposed at a position located away from the branch wire. However, because the conductor 2 is constituted by the twisted wire 2S that includes the metallically bonded portions 24, the conductor 2 has good weld strength even if the conductor 2 includes elemental wires 20 that are not directly welded to the branch wire or the like as described above. Also, it is expected that connection resistance of a welding portion can also be reduced due to the conductor 2 including the metallically bonded portions 24.

The branch wire may have the same configuration as the covered electrical wire 1 of this embodiment and the terminal-equipped electrical wire 10 of this embodiment. Alternatively, if the elemental wires 20 constituting the conductor 2 (the twisted wire 2S) are copper alloy wires, a branch wire may be a covered electrical wire including a copper conductor constituted by pure copper, or the like. In this case, it is possible to construct a wire welding structure in which the wire includes a welding portion where the covered electrical wire 1 of this embodiment provided with the conductor 2 constituted by the copper alloy twisted wire 2S or the terminal-equipped electrical wire 10 of this embodiment, a covered electrical wire for branching provided with a copper conductor constituted by pure copper, an exposed portion of the conductor 2 that is exposed from the insulating coating layer 3, and a portion of the copper conductor are welded to each other. Generally, pure copper has lower strength than that of a copper alloy. Thus, in this wire welding structure, if the cross-sectional area of the copper conductor is made larger than that of the conductor 2 constituted by a copper alloy, strength of the welding portion can be easily increased.

Effects

The covered electrical wire 1 of this embodiment and the terminal-equipped electrical wire 10 of this embodiment exhibit special effects that the covered electrical wire 1 and the terminal-equipped electrical wire 10 are unlikely to buckle, have low contact resistance between elemental wires 20, and have low contact resistance between the conductor 2 (the twisted wire 2S) and the terminal portion 4 in a case where the degree of compression of the terminal portion 4 is small, and have good weld strength in a case where a branch wire or the like is welded thereto, because although the twisted wire 2S is used as the conductor 2, the twisted wire 2S includes the metallically bonded portions 24. These effects will be described specifically in test example 1, which will be described later. Use of the twisted wire 2S of this embodiment as the conductor 2 makes it possible to construct the covered electrical wire 1 and the terminal-equipped electrical wire 10 that are unlikely to buckle whereas bending or the like can be performed thereon. Also, use of the twisted wire 2S of this embodiment as the conductor 2 makes it possible to construct the covered electrical wire 1 and the terminal-equipped electrical wire 10 that have low contact resistance with the terminal portion 4 even in a case where the degree of compression of the terminal portion 4 is low, and the covered electrical wire 1 and the terminal-equipped electrical wire 10 that have good weld strength in a case where a branch wire or the like is welded thereto.

Method for Manufacturing Twisted Wire and Covered Electrical Wire

The twisted wire 2S of this embodiment can be manufactured by, typically, preparing and twisting together a plurality of copper wires or copper alloy wires. A known manufacturing method can be referred to for basic conditions under which copper wires, copper alloy wires, and twisted wires thereof are manufactured. The covered electrical wire 1 of this embodiment can be manufactured using, typically, a manufacturing method including a process for preparing the conductor 2 constituted by copper or a copper alloy and a process for forming the insulating coating layer 3 on the outer periphery of the conductor 2. The twisted wire 2S is used as the conductor 2. A known manufacturing method for manufacturing a covered electrical wire provided with a twisted wire conductor and an insulating coating layer covering the outer periphery of this conductor can be referred to for basic conditions under which the covered electrical wire 1 is manufactured and the like. The insulating coating layer 3 may be formed using an extrusion method, or the like.

In particular, manufacturing of the twisted wire 2S of this embodiment (the conductor 2 of covered electrical wire 1 of this embodiment) includes a process for performing heat treatment for forming the metallically bonded portions 24 after a plurality of copper wires or a plurality of copper alloy wires are twisted together. Although the heat treatment can be performed independent of aging or softening, it is preferable to perform heat treatment that also serves as aging or softening because the number of heat treatment processes can be reduced, thus increasing mass productivity.

Hereinafter, a pre-twisting copper wire or copper alloy wire may be referred to as a "single wire", and a twisted wire before heat treatment for forming the above-described metallically bonded portions 24 is performed may be referred to as an "unbonded twisted wire".

Also, the inventor of the present invention found that if the amount of oil adhering to the surfaces of the elemental wires constituting the above-described unbonded twisted wire is somewhat small, the metallically bonded portions 24 can be easily formed. It was found that, quantitatively, the amount of oil adhering to the surfaces of the elemental wires is preferably 10 μg or less with respect to 1 g mass of an elemental wire (10 μg/g or less). In view of this, as one condition under which the twisted wire 2S including the metallically bonded portions 24 is manufactured, the oil adhering amount of elemental wires constituting the unbonded twisted wires is set to 10 μg/g or less.

Note that exemplary examples of the above-described oil adhering to the surfaces of the elemental wires include mineral oil and synthetic oil, and the oil originates from a lubricant (also having a function other than a lubrication function, such as a discoloration prevention function) that is used in a process for manufacturing a copper wire or a copper alloy wire that is to serve as an elemental wire. Such lubricants are used typically in plastic forming such as wiredrawing.

Process for Preparing Conductor

Single Wire

Single wires used as the conductor 2 (the twisted wire 2S) can be manufactured using, typically, a manufacturing method including a process for casting copper or a copper alloy, a process for performing plastic forming such as rolling and conform extrusion on a cast material, and a process for wiredrawing a plastically formed material. Various types of continuous casting can be used for casting. A continuous cast-rolling material that is to be rolled following continuous casting can be used for wiredrawing. Heat treatment can be performed during or after wiredrawing as appropriate. Heat treatment here may be performed to remove processing strain resulting from wiredrawing, for example.

If an appropriate lubricant is used during wiredrawing, wire breakage is unlikely to occur, and good wire drawability can be obtained. If this lubricant is applied, for example, the oil adhering amount of a pre-twisting single wire may be set to 10 μg/g or less by reducing the amount of applied lubricant or performing heat treatment for reducing and removing the lubricant remaining after wiredrawing is performed. Alternatively, the adhering amount of elemental wires constituting an unbonded twisted wire may be set to 10 μg/g or less by performing heat treatment for reducing and removing the lubricant remaining after single wires are twisted together and subjected to compression molding. It is preferable to adjust heat treatment here such that the above-described oil adhering amount is 10 μg/g or less, according to oil components and the like. If the oil adhering amount satisfies 10 μg/g or less by reducing the application amount, it is possible to omit heat treatment for reducing and removing the lubricant.

Unbonded Twisted Wire

A plurality of prepared single wires are twisted together at a predetermined twist pitch. In the case of a concentrically twisted wire, the twisted wire is obtained by twisting a plurality of single wires around the outer periphery of one or more single elemental wires at a predetermined twist pitch.

Twist Pitch

A twist pitch can be selected as appropriate. If the conductor 2 (the twisted wire 2S) is constituted by a concentrically twisted wire and has a cross-sectional area of 0.22 $mm^2$ or less, for example, the twist pitch may be set to 12 mm to 20 mm inclusive. If the twist pitch is 12 mm or more, the twist pitch is somewhat large, and thus the conductor 2 has high strength and is unlikely to buckle even if the conductor 2 has a small cross-sectional area. If the twist pitch is 20 mm or less, the twist pitch is not excessively large, and the elemental wires 20 are likely to move as a whole. Buckling is unlikely to occur also in this respect. If higher strength is needed, the twist pitch may be 14 mm or more, 14.5 mm or more, 15 mm or more, and 15.5 mm or more. If further integration of elemental wires 20 is needed, the twist pitch may be 18 mm or less, and 16 mm or less.

Compression Ratio

If the conductor 2 (the twisted wire 2S) is an uncompressed twisted wire in which the elemental wires 20 are just twisted, a compression molding process can be eliminated. Alternatively, if the conductor 2 (the twisted wire 2S) is a compressed twisted wire (see FIG. 1) obtained through compression molding after twisting together elemental wires, the following effects are obtained.

(1) The outer diameter of the twisted wire 2S can be made smaller than that of an uncompressed twisted wire, and a covered electrical wire 1 having a smaller diameter can be obtained.

(2) A transverse cross-sectional shape can be a desired shape such as a circle.

(3) The number of portions where adjacent elemental wires are in surface contact with each other is large in an unbonded twisted wire before heat treatment for forming the metallically bonded portions 24 is performed, and the metallically bonded portions 24 can be easily formed.

(4) The insulating coating layer 3 can be easily formed.

(5) An increase in strength through work hardening during compression forming can be expected.

Thus, it is possible to obtain a covered electrical wire 1 that is less likely to buckle, a covered electrical wire 1 having lower contact resistance between elemental wires 20, and a covered electrical wire 1 having higher weld strength.

When the ratio of the cross-sectional area that has decreased through compression molding to the total cross-sectional area of the pre-twisting single wires (e.g., the total area of seven single wires in the case of a 7-twisted wire), that is, {(the total cross-sectional area of pre-twisting singles wires−the cross-sectional area of a compressed twisted wire)/the total cross-sectional area of pre-twisting single wires}×100, is a compression ratio (%) of a compressed twisted wire, the higher the compression ratio is, the more likely the strength is to increase. Note that if the above-described compression ratio is too high, there is a possibility that toughness such as breaking elongation will decrease, or impact resistance will decrease, or it will be difficult to crimp a terminal portion. Considering an increase in strength, ensuring toughness and impact resistance, and the like, a compressed twisted wire preferably has a compression ratio of 10% to 30% inclusive, and may have a compression ratio of 12% to 25% inclusive, and 12% to 20% inclusive. The compression ratio may be preset in a manufacturing process, and the above-described range can be achieved by performing compression molding based on the set value.

Heat Treatment

It is expected that if a pre-twisting single wire, a twisted wire with the single wires twisted together (an example of an unbonded twisted wire), or a compressed twisted wire (another example of the unbonded twisted wire) is constituted by copper alloy wires, as a result of performing heat treatment such as aging and softening, strength will increase due to dispersion of precipitates being strengthened (precipitation alloy), electrical conductivity will increase due to a reduction in the amount of a solid-solution element (precipitation alloy, solid-solution alloy), and elongation and impact resistance will increase through softening (precipitation alloy, solid-solution alloy), for example, although this depends on the composition of the copper alloy. It is expected that if the above-described single wire, twisted wire, or compressed twisted wire is constituted by a copper wire, elongation, impact resistance, and electrical conductivity will increase through softening.

Examples of the heat treatment conditions for the purpose of aging and softening for the above-described compositions (1) and (2) are as follows.

Composition (1) heat treatment temperature: 400° C. to 650° C. inclusive, and 450° C. to 600° C. inclusive, holding time period: 1 hour to 40 hours inclusive, and 4 hours to 20 hours inclusive.

Composition (2) heat treatment temperature: 350° C. to 550° C. inclusive, and 400° C. to 500° C. inclusive, holding time period: 1 hour to 40 hours inclusive, and 4 hours to 20 hours inclusive.

Examples of the heat treatment conditions for the purpose of softening pure copper are as follows.

Heat treatment temperature: 100° C. to 350° C. inclusive, and 120° C. to 200° C. inclusive, holding time period: 1 hour to 8 hours inclusive, and 2 hours to 4 hours inclusive.

The inventor of the present invention found that when the above-described heat treatment for the purpose of aging and softening is performed on the above-described unbonded twisted wire (the twisted wire or compressed twisted wire), in particular, at least a portion where adjacent elemental wires 20 and 20 are in contact with each other is likely to be metallically bonded by adjusting an atmosphere of heat treatment. Specifically, it was found that the atmosphere of heat treatment is preferably a reducing atmosphere having a low oxygen content, or an inert atmosphere having a low oxygen content. Also, it was found that, as described above, if the amount of oil adhering to the elemental wires constituting the unbonded twisted wire is small, the metallically bonded portions 24 can be more reliably formed. One reason for this is as follows. If heat treatment is performed in a reducing atmosphere or an inert atmosphere having a low oxygen content, oil content originating from a lubricant remaining on the surfaces of the elemental wires volatilizes. It is conceivable that new surfaces of the elemental wires appear during volatilization, the new surfaces are not oxidized because the amount of oxygen is very small, and the new surfaces are metallically bonded to each other. Also, it is conceivable that oil content is likely to volatilize because the oil adhering amount is relatively small, and the new surfaces are likely to be generated.

The oxygen content in the atmosphere of the heat treatment is 10 ppm by volume or less, for example. It is preferable to reduce and remove oxygen in a heat treatment furnace and then fill the heat treatment furnace with reducing gas or inert gas such that the oxygen content satisfies the above-described range. Examples of reducing gas constituting a reducing atmosphere include hydrogen and carbon monoxide. Examples of inert gas constituting an inert atmosphere include nitrogen and argon. It is conceivable that, in particular, in a reducing atmosphere, oxidation of the new surfaces thereof that have appeared can be easily prevented, and the new surfaces can be more reliably metallically bonded to each other. If heat treatment is performed in which the heat treatment temperature and the holding time period are in the above-described specific ranges and the heat treatment atmosphere is a reducing atmosphere or an inert atmosphere with low oxygen content, the above-described volatilization of oil content, generation of new surfaces, and formation of metallic bonding successively occur at portions where adjacent elemental wires are in contact with each other and the vicinities thereof, and aging precipitation and softening occur in portions of the elemental wires other than the contact portions and the vicinities thereof. Note that there are cases where the above-described oil content can be reduced and removed in a temperature raising process up to the above-described predetermined heat treatment temperature, or in the initial stage of starting to hold the predetermined heat treatment temperature, for example.

When the above-described heat treatment temperature is kept constant, if the holding time period is long in the above-described range, the number of metallically bonded portions 24 is likely to increase, and the above-described bond lengths L and the total length of the bond lengths L are likely to increase.

Method for Manufacturing Terminal-Equipped Electrical Wire

The terminal-equipped electrical wire 10 of this embodiment can be manufactured using a manufacturing method including a process for exposing an end portion of the conductor 2 by removing the insulating coating layer 3 located on at least one end side of the covered electrical wire 1, and a process for attaching the terminal portion 4 to the end portion of the conductor 2. If the terminal portion 4 is a crimp terminal, crimping is performed to a predetermined crimp height (C/H). At this time, it is preferable to adjust C/H such that the remaining area ratio of the conductor 2 (details have been described above) is somewhat increased as described above.

Test Example 1

Copper alloy wires were used as elemental wires to produce a twisted wire, and a state where adjacent elemental wires are bonded was examined. Also, the produced twisted wire was used as a conductor to produce a covered electrical wire, a terminal portion was attached to an end portion of the covered electrical wire, and a buckling state thereof and contact resistance with the terminal portion were examined. Also, a copper conductor was welded to the produced covered electrical wire, and weld strength was examined.

Production of Samples

A copper alloy wire to be used as an elemental wire was produced as follows. A continuous cast material (having a diameter of ø12.5 mm) was produced using a molten copper alloy, the surface thereof was cut as appropriate, and cold rolling was then performed. Wiredrawing was performed on the obtained rolled material, and a concentrically twisted wire in which six outer peripheral elemental wires cover the outer periphery of one central elemental wire was produced using seven of the obtained copper alloy wires (round wires having a diameter of ø0.172 mm). After the obtained copper alloy wires were twisted together, a compressed twisted wire was produced through compression molding. Also, heat treatment was performed on the compressed twisted wire.

In this test, the following items were shared, except that heat treatment conditions for the samples were different from each other.

Shared Items

The copper alloy contains Fe in an amount of 0.61 mass %, P in an amount of 0.12 mass %, and Sn in an amount of 0.26 mass %, the remaining portion including Cu and inevitable impurities.

A lubricant is used in wiredrawing. The amount of applied lubricant may be adjusted or the lubricant remaining after wiredrawing is performed may be removed such that the amount of oil adhering to the surface of a wiredrawn copper alloy wire is 10 μg or less with respect to 1 g mass of the copper alloy wire.

The twist pitch is selected from the range of 14 mm to 20 mm inclusive. Compression molding is performed at a compression ratio of 20%, and the compressed twisted wire obtained after compression molding is performed has a cross-sectional area of 0.13 $mm^2$. The above-described compression ratio (%) was obtained using {(the total cross-sectional area of the seven pre-twisting copper alloy wires−the cross-sectional area of the compressed twisted wire)/the total cross-sectional area of the seven pre-twisting copper alloy wires}×100.

A conductor is obtained by performing heat treatment on the compressed twisted wire under the following heat treatment conditions.

Heat Treatment Conditions

The heat treatment temperature was selected from the range of 400° C. to 500° C. inclusive. The holding time period was selected from the range of 4 hour to 12 hours inclusive. The heat treatment atmosphere was a reducing atmosphere mainly containing hydrogen, and the oxygen content was 10 ppm by volume or less.

With Samples No. 1-1 to No. 1-8, the heat treatment temperature was the same, and was selected from the above-described range such that the larger the sample number was, the longer the holding time period was.

With Sample No. 1-101, the heat treatment temperature and the heat treatment atmosphere were the same as those of Sample No. 1-1 or the like, and the holding time period was less than 4 hours, which is outside the range and is shorter than that of Sample No. 1-1 or the like.

With Sample No. 1-102, the heat treatment temperature and the holding time period were the same as those of Sample No. 1-1, and the oxygen content of the heat treatment atmosphere was changed. Specifically, the oxygen content was about 0.1% by volume, and was higher than that of Sample No. 1-1.

Note that the heat treatment corresponded to aging, and corresponded to heat treatment for forming metallically bonded portions in Samples No. 1-1 to No. 1-8.

Evaluation of Twisted Wire

Figure 4:
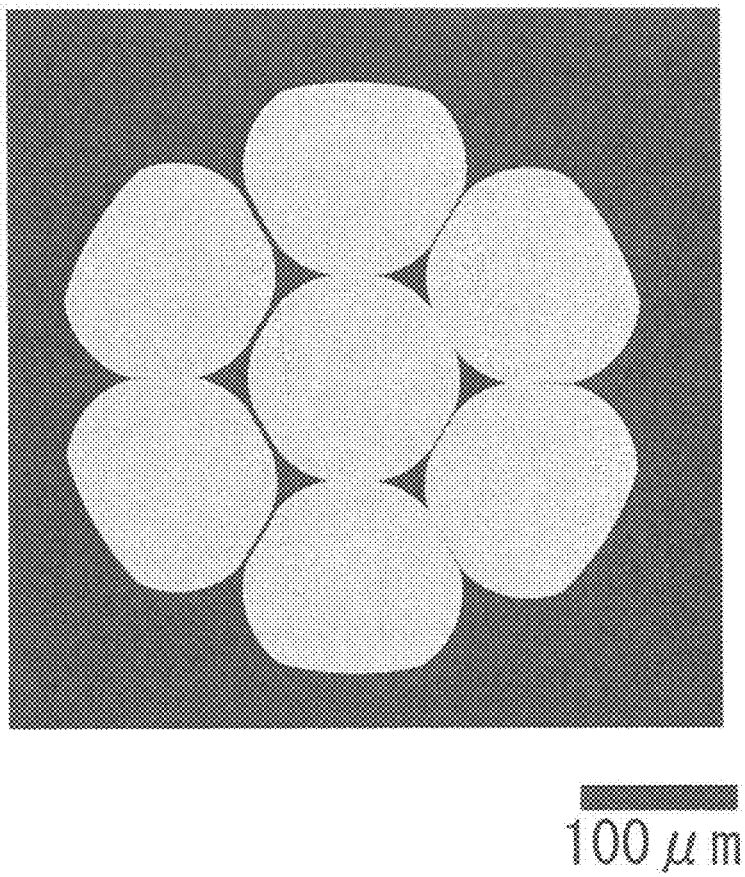
FIG. 4 is a microphotograph showing a transverse cross-section of a conductor of Sample No. 1-1 in Test Example 1.

The compressed twisted wire on which heat treatment was performed under the above-described conditions was cut along a plane orthogonal to the axial direction thereof to obtain the transverse cross-section, and the transverse cross-section was observed using an optical microscope to examine the state of adjacent elemental wires. Here, it was examined whether or not there was a portion where adjacent elemental wires were metallically bonded to each other. Also, if there were portions where adjacent elemental wires are metallically bonded to each other, the number thereof, and the total length (mm) of bond lengths of the portions where adjacent elemental wires are metallically bonded to each other were obtained. Here, these portions were divided into portions A, where a central elemental wire and an outer peripheral elemental wire are metallically bonded to each other, and portions B, where adjacent outer peripheral elemental wires are metallically bonded to each other, and the number of metallically bonded portions, and the bond lengths thereof were examined. The results are shown in Table 1. FIG. 4 shows an observation image obtained by observing the compressed twisted wire of Sample No. 1-1 (a 7-elemental wire concentrically twisted wire on which the above-described heat treatment was performed) using an optical microscope, and FIG. 2 corresponds to a schematic diagram obtained by tracing the observation image. Here, a region of the observation image where the boundary between adjacent elemental wires cannot be visually identified was extracted from the observation image as a metallically bonded portion. In the observation image shown in FIG. 4, the metallically bonded portions are present in portions surrounded by one-dot chain line circles in FIG. 2. A bond length of each metallically bonded portion is the minimum distance (see a bond length L shown in FIG. 2) of a region of the observation image where the above-described boundary cannot be visually identified, and the total distance of the minimum distances of the portions is regarded as a total length (mm). Here, the length of a measurement sample was set to 50 mm to 100 mm inclusive, the number of transverse cross-sections collected from this sample was 3 or more, and the average thereof is shown in Table 1. Note that in this test, in samples in which metallically bonded portions were recognized, the metallically bonded portions were recognized at an interval of 2% to 20% inclusive with respect to the length of the measurement sample.

An insulating coating layer made of a constituent material shown in Table 1 was formed through extrusion on the outer periphery of the conductor (the conductor had a cross-sectional area of 0.13 $mm^2$) prepared as described above such that the formed insulating coating layer had a thickness (mm) shown in Table 1. In the coating type shown in Table 1, PVC refers to polyvinyl chloride, and HF (PP) refers to halogen-free polypropylene. The coating thickness shown in Table 1 refers to the average of thicknesses of portions covering the above-described crown portion. Note that when the average thickness of an insulating coating layer for a covered electrical wire of each sample that was ultimately obtained was measured, it was confirmed that the measured values were substantially equal to the values shown in Table 1.

Evaluation of Covered Electrical Wire

Buckling Force

A terminal-equipped electrical wire was produced by attaching a crimp terminal to an end portion of a covered electrical wire of each of the prepared samples. Here, the crimp height was adjusted such that the ratio (the remaining area ratio) of the cross-sectional area of a compressed portion of a conductor to which the terminal portion is attached to the cross-sectional area of an uncompressed portion of the conductor to which the terminal portion is not attached was 0.79.

With regard to a terminal-equipped electrical wire of each of the prepared samples, a buckling force occurring when the terminal portion is housed in a terminal housing portion of a housing was measured presuming the following. The results are shown in Table 1.

The terminal portion of the terminal-equipped electrical wire was held, and a leading end portion that is located opposite to the terminal portion of the covered electrical wire was pressed against a flat plate. In this test, a pressing operation was performed under the conditions that the length of the covered electrical wire is 10 mm (the length of a portion of the covered electrical wire that protrudes from a portion where the terminal portion is held to the above-described leading end portion), the speed of the held terminal-equipped electrical wire is 200 mm/min, and the load applied when the above-described leading end portion of the covered electrical wire is pressed against the flat plate is changed. Also, the maximum load applied when a covered electrical wire buckled was measured, and the obtained maximum load was regarded as the buckling force (N).

Terminal Insertability

With regard to a terminal-equipped electrical wire of each of the prepared samples, a terminal-equipped electrical wire in which the above-described buckling force is 7 N or more was evaluated as G because the terminal-equipped electrical wire is unlikely to buckle and has good terminal insertability, a terminal-equipped electrical wire in which the buckling force is less than 7 N was evaluated as B because the terminal-equipped electrical wire is likely to buckle and has bad terminal insertability. Results of evaluation are shown in Table 1.

Contact Resistance

A terminal-equipped electrical wire was produced by attaching a crimp terminal to an end portion of a covered electrical wire of each of the prepared samples. Here, the crimp height was adjusted such that the above-described remaining area ratio was 0.85.

With regard to a terminal-equipped electrical wire of each of the prepared samples, contact resistance between a conductor and a terminal portion (mΩ/m) was measured based on JASO D616, Automotive Parts-Low Voltage Cables, no. 6.8. In this test, a crimp terminal was attached to each end portion of a covered electrical wire, and two points located 150 mm apart from each crimp terminal were used as resistance measurement points. A power source was attached to both crimp terminals, a voltage was applied to a terminal-equipped electrical wire including crimp terminals at both end portions thereof at an applied voltage of 15 mV and a flowing current of 15 mA, and resistance between the above-described two measurement points was measured. Contact resistance (mΩ/m) was obtained by subtracting the resistance of the covered electrical wire from the measured resistance value. The results are shown in Table 1.

Weld Strength

With regard to a covered electrical wire of each of the prepared samples, a copper conductor constituted by pure copper was welded, and weld strength (N) was measured with reference to a method for measuring a peeling force of Patent Document 1 shown in FIG. 5. The results are shown in Table 1.

Here, one covered electrical wire of each sample and two covered electrical wires including a pure copper conductor were prepared (both had a length of 150 mm), the insulating coating layer was removed from an end portion of each covered electrical wire to expose a copper alloy conductor and a copper conductor, and ultrasonic welding was performed with the copper conductor placed to hold the copper alloy conductor. A commercially available welding apparatus was used in welding. Also, two covered electrical wires including a copper conductor were pulled away from each other in a state in which the covered electrical wire of each sample including a copper alloy conductor was fixed. As shown in FIG. 5 disclosed in Patent Document 1, for example, a welding portion and a covered electrical wire of each sample were disposed in a horizontal direction, the covered electrical wire was fixed, the two covered electrical wires including a copper conductor were disposed in a vertical direction, and one of the two covered electrical wires was pulled upward and the other was pulled downward. A commercially available tension tester or the like was used in tensile testing. The maximum load (N) at which the welding portion broke was measured, and the obtained maximum load was regarded as weld strength. Note that strength of pure copper conductor is inferior to that of a copper alloy conductor. Thus, here, the total cross-sectional area ($mm^2$) of two pure copper conductors was set to be larger than the cross-sectional area (0.13 $mm^2$) of a conductor of each sample constituted by a copper alloy.

(c) The total length of the bond lengths of the metallically bonded portions where the central elemental wire and outer peripheral elemental wires are metallically bonded to each other, and the total length of the bond lengths of the metallically bonded portions where adjacent outer peripheral elemental wires are metallically bonded to each other exceeded 0.02 mm, was 0.05 mm or more, and was 0.06 mm or more, and the total bond lengths of many samples were 0.10 mm or more. The sum of the total length of the bond lengths of the metallically bonded portions where the central elemental wire and outer peripheral elemental wires are metallically bonded to each other, and the total length of the bond lengths of the metallically bonded portions where adjacent outer peripheral elemental wires are metallically bonded to each other was 0.05 mm or more, and 0.10 mm or more, and many samples had a sum of 0.20 mm or more.

It can be said that according to comparison between Samples No. 1-1 to No. 1-8, the larger the number of metallically bonded portions is, and the longer the total length of the bond lengths is, the higher the buckling force is. It is thought that one reason for such results is that a plurality of metallically bonded portions are present, and the bond length thereof is long, and thus adjacent elemental wires are unlikely to slide against each other, and a plurality of elemental wires are likely to move as a whole, thus increasing the rigidity of the twisted wire overall. From these findings, it can be said that the presence or absence of metallically bonded portions formed as a result of adjacent elemental wires being metallically bonded affects the likelihood of buckling, and if the number of metallically bonded portions is larger or the bond lengths thereof are longer, buckling is unlikely to occur.

TABLE 1

| | Bonded state of elemental wires | | | | | | | | | | |
|---|---|---|---|---|---|---|---|---|---|---|---|
| | Portion A where central elemental wire and outer peripheral elemental wires are metallically bonded to each other | | Portion B where adjacent outer peripheral elemental wires are metallically bonded to each other | | Cross-sectional | | | | | Contact resistance | |
| Sample No. | Number of portions A | Total length (mm) | Number of portions B | Total length (mm) | area of conductor ($mm^2$) | Coating type | Coating thickness (mm) | Buckling force (N) | Terminal insertability | (mΩ/m) Remaining area ratio 0.85 | Weld strength (N) |
| 1-1 | 3 | 0.06 | 3 | 0.07 | 0.13 | PVC | 0.23 | 7.6 | G | 0.254 | 15.6 |
| 1-2 | 4 | 0.08 | 5 | 0.10 | 0.13 | HF(PP) | 0.25 | 8.5 | G | 0.191 | 19.2 |
| 1-3 | 5 | 0.10 | 4 | 0.08 | 0.13 | HF(PP) | 0.25 | 8.5 | G | 0.191 | 19.2 |
| 1-4 | 6 | 0.10 | 4 | 0.06 | 0.13 | PVC | 0.23 | 8.8 | G | 0.170 | 20.4 |
| 1-5 | 4 | 0.08 | 6 | 0.12 | 0.13 | HF(PP) | 0.25 | 8.8 | G | 0.170 | 20.4 |
| 1-6 | 5 | 0.10 | 6 | 0.12 | 0.13 | PVC | 0.23 | 9.1 | G | 0.149 | 21.6 |
| 1-7 | 6 | 0.12 | 5 | 0.10 | 0.13 | PVC | 0.23 | 9.1 | G | 0.149 | 21.6 |
| 1-8 | 6 | 0.12 | 6 | 0.12 | 0.13 | PVC | 0.23 | 9.4 | G | 0.128 | 22.8 |
| 1-101 | 1 | 0.02 | 1 | 0.02 | 0.13 | PVC | 0.23 | 6.4 | B | 1.468 | 10.8 |
| 1-102 | 0 | 0 | 0 | 0 | 0.13 | PVC | 0.22 | 5.8 | B | 1.948 | 8.4 |

As shown in Table 1, it was found that Samples No. 1-1 to No. 1-8, and No. 1-101, in which the conductor is a copper-based twisted wire and that are provided with portions (metallically bonded portions) where, out of the elemental wires constituting the twisted wire, adjacent elemental wires are metallically bonded to each other, had a higher buckling force and were unlikely to buckle, compared to Sample No. 1-102 that is provided with no metallically bonded portion. In particular, it was found that Samples No. 1-1 to No. 1-8 had a higher buckling force (a), a larger number of metallically bonded portions (b), a longer total bond length (c), and better workability when a terminal portion is inserted into a housing, compared to Sample No. 1-101.

Quantitatively, Samples No. 1-1 to No. 1-8 were as follows.

(a) The buckling forces thereof were 7 N or more.

(b) The samples each had three or more metallically bonded portions where the central elemental wire and outer peripheral elemental wires are metallically bonded to each other, and three or more metallically bonded portions where adjacent outer peripheral elemental wires are metallically bonded to each other, and thus had a plurality of both types of metallically bonded portions.

Also, it was found that, compared to Sample No. 1-102 provided with no metallically bonded portion, Samples No. 1-1 to No. 1-8, and No. 1-101 provided with the above-described metallically bonded portions had a higher remaining area ratio, which has been described above, at 0.85, and had low contact resistance between the conductor and the terminal portion even if the degree of compression of the conductor at which the terminal portion is compressed is small. In particular, the contact resistances of Samples No. 1-1 to No. 1-8 were lower than that of Sample No. 1-101. Quantitatively, the contact resistances of Samples No. 1-1 to No. 1-8 were 0.4 mΩ/m or less, and 0.3 mΩ/m or less, and the contact resistances of many of the samples were 0.2 mΩ/m or less. Also, it can be said that according to comparison between Samples No. 1-1 to No. 1-8, the larger the number of metallically bonded portions is, and the longer the total length of the bond lengths is, the lower the contact resistance is. It is thought that one reason for such results is that contact resistance between elemental wires can be reduced due to a plurality of metallically bonded portions being provided and the bond length thereof being long, even if, out of the plurality of elemental wires, there are elemental wires that are not in direct contact with the terminal portion. From these findings, it can be said that the presence or absence of metallically bonded portions formed as a result of adjacent elemental wires being metallically bonded affects contact resistance between elemental wires, and contact resistance between the terminal portion and the conductor constituted by a twisted wire, and if the number of metallically bonded portions is larger or the bond lengths thereof are longer, the contact resistance can be more easily reduced.

Also, it was found that Samples No. 1-1 to No. 1-8, and No. 1-101 provided with the above-described metallically bonded portions had higher weld strength, compared to Sample No. 1-102 provided with no metallically bonded portion. In particular, Samples No. 1-1 to No. 1-8 had higher weld strength, compared to Sample No. 1-101. Quantitatively, the weld strengths of Samples No. 1-1 to No. 1-8 were 12 N or more, and 15 N or more, and the weld strengths of many samples were 18 N or more. Also, it can be said that according to comparison between Samples No. 1-1 to No. 1-8, the larger the number of metallically bonded portions is, and the longer the total length of the bond lengths is, the higher the weld strength is. It is thought that one reason for such results is that portions where elemental wires are tightly joined to each other due to a plurality of metallically bonded portions being provided and the bond lengths thereof being long were present in the vicinity of a welding portion, even if portions that are not directly welded to a branch wire are present in the twisted wire constituting the conductor. From these findings, it can be said that the presence or absence of metallically bonded portions formed as a result of adjacent elemental wires being metallically bonded affects weld strength, and if the number of metallically bonded portions is larger or the bond lengths thereof are longer, weld strength can be more easily increased.

In addition, the following can be understood from this test.

(x) With Samples No. 1-1 to No. 1-8, although the conductor had a cross-sectional area of 0.15 $mm^2$ or less, or 0.13 $mm^2$ or less, the twist pitch was large at 14 mm or more. From these findings as well, it is thought that the strength of a twisted wire constituting a conductor was increased, and elemental wires were likely to move as a whole, thus contributing to an increase in buckling force.

(y) With Samples No. 1-1 to No. 1-8, a conductor was a compressed twisted wire, and the compression ratio thereof was set to a specific range of 10% to 30% inclusive. It is expected that strength increases through work hardening in compression molding, and it is thought that setting the compression ratio to this specific range contributes to an increase in buckling force. Also, it is thought that each elemental wire and a terminal portion can easily come into surface contact with each other through compression molding, thus contributing to a decrease in the above-described contact resistance.

(z) In order to form metallically bonded portions, heat treatment is preferably performed after elemental wires are twisted together, and in particular, the atmosphere of this heat treatment is preferably a reducing atmosphere in which the oxygen content is 10 ppm by volume or less. If the heat treatment holding time period is increased to 4 hours or longer, a larger number of metallically bonded portions are likely to be formed, and the bond lengths thereof are likely to be long. Also, it is preferable to reduce the amount of oil adhering to the surfaces of the elemental wires constituting the twisted wire before the heat treatment is performed.

In addition, with the prepared covered electrical wires of Samples No. 1-1 to No. 1-8, the conductor had a tensile strength of 450 MPa or more, and 500 MPa or more, which is high strength. It is thought that high strength contributes to an increase in buckling force and an increase in weld strength. Also, with the covered electrical wires of Samples No. 1-1 to No. 1-8, the conductor had a breaking elongation of 5% or more, and 8% or more, which is high toughness. It is expected that the covered electrical wires of Samples No. 1-1 to No. 1-8 have good impact resistance because these covered electrical wires have high strength and high toughness. Note that the tensile strength and the breaking elongation of the conductors were measured as follows. A covered electrical wire was cut to a predetermined length, and a conductor was exposed by removing an insulating coating layer using an appropriate cutting tool such as a feather. The resulting conductor was used as a sample, and tensile testing was performed conforming to JIS Z 2241 (Metallic materials-Tensile testing-Method, 1998), using a general-purpose tension tester, under conditions that an evaluation distance GL is 250 mm and tensile speed is 50 mm/min. Tensile strength (MPa) was obtained using {breaking load (N)/the cross-sectional area ($mm^2$) of a conductor}. Breaking elongation (total elongation, %) was obtained using {breaking displacement (mm)/250 (mm)}×100.

The present invention is not limited to these examples, and is defined by the claims, and all changes that come within the meaning and range of equivalency of the claims are intended to be embraced therein.

The composition of a copper alloy of Test Example 1, the cross-sectional area of a copper alloy wire, the number of elemental wires, and heat treatment conditions can be changed as appropriate, for example. If a conductor is a twisted wire constituted by copper alloy wires, the above-described compositions (1), (3), and (4) are possible, for example. Alternatively, a conductor may be a twisted wire constituted by copper wires. It is expected that metallically bonded portions can be more easily formed because no precipitates and the like substantially are present on new surfaces in a twisted wire constituted by copper wires when the new surfaces are generated as described above in the manufacturing process.

LIST OF REFERENCE NUMERALS

1 Covered electrical wire
10 Terminal-equipped electrical wire
2 Conductor
2S Twisted wire
20 Elemental wire
21 Central elemental wire
22 Outer peripheral elemental wire
24 Metallically bonded portion
200 Envelope circle
3 Insulating coating layer
4 Terminal portion
40 Wire barrel portion
42 Fitting portion
44 Insulation barrel portion

The invention claimed is:

1. A covered electrical wire comprising:

a conductor formed of a twisted wire obtained by concentrically twisting a plurality of elemental wires constituted by copper or a copper alloy, the plurality of elemental wires including at least one central elemental wire and a plurality of outer peripheral elemental wires covering an outer periphery of the at least one central elemental wire, the twisted wire including a plurality of metallically bonded portions that are disposed apart from each other in an axial direction of the twisted wire, the plurality of metallically bonded portions each being formed as a result of the plurality of elemental wires that are adjacent to each other being metallically bonded to each other, and the plurality of metallically bonded portions are divided into groups of bonded portions that are each only located at intervals, which are separated from each other in an axial direction of the covered electrical wire, along an axial length of the covered electrical wire; and an insulating coating layer covering an outer periphery of the conductor, wherein:

the covered electrical wire has a specific cross-section obtained by cutting along a plane orthogonal to the axial direction of the covered electrical wire, and the plurality of outer peripheral elemental wires in the specific cross-section include:

an outer peripheral elemental wire of the plurality of outer peripheral elemental wires that is bonded to the at least one central elemental wire by the metallically bonded portion of the plurality of metallically bonded portions, and an outer peripheral elemental wire of plurality of outer peripheral elemental wires that is not metallically bonded to the at least one central elemental wire.

2. The covered electrical wire according to claim 1, further comprising two or more outer peripheral elemental wires of the plurality of outer peripheral elemental wires that are metallically bonded to the at least one central elemental wire.

3. The covered electrical wire according to claim 2, wherein:

the plurality of elemental wires are made of the copper alloy, and the copper alloy contains one or more elements selected from Fe, Ti, Mg, Sn, Ag, Ni, In, Zn, Cr, Al, and P in a total amount of 0.01 mass % to 5.5 mass % inclusive, the remaining portion including Cu and inevitable impurities.

4. A terminal-equipped electrical wire comprising:

the covered electrical wire according to claim 3; and a terminal portion attached to an end portion of the covered electrical wire.

5. A terminal-equipped electrical wire comprising:

the covered electrical wire according to claim 2; and a terminal portion attached to an end portion of the covered electrical wire.

6. The covered electrical wire according to claim 1, wherein:

the plurality of elemental wires are made of the copper alloy, and the copper alloy contains one or more elements selected from Fe, Ti, Mg, Sn, Ag, Ni, In, Zn, Cr, Al, and P in a total amount of 0.01 mass % to 5.5 mass % inclusive, the remaining portion including Cu and inevitable impurities.

7. A terminal-equipped electrical wire comprising:

the covered electrical wire according to claim 6; and a terminal portion attached to an end portion of the covered electrical wire.

8. A terminal-equipped electrical wire comprising:

the covered electrical wire according to claim 1; and a terminal portion attached to an end portion of the covered electrical wire.

9. The covered electrical wire according to claim 1, wherein the plurality elemental wires that are adjacent to each other are metallically bonded to each other, which maintains a constant diameter of each elemental wire of the plurality of elemental wires and an overall diameter of the conductor.

10. A twisted wire functioning as a conductor of an electrical wire, the twisted wire comprising:

a plurality of elemental wires constituted by copper or a copper alloy, the plurality of elemental wires being concentrically twisted to form the twisted wire, and the plurality of elemental wires include at least one central elemental wire and a plurality of outer peripheral elemental wires covering an outer periphery of the at least one central elemental wire; and a plurality of metallically bonded portions disposed apart from each other in an axial direction of the twisted wire, the plurality of metallically bonded portions each being formed as a result of the plurality of elemental wires that are adjacent to each other being metallically bonded to each other, and the plurality of metallically bonded portions are divided into groups of bonded portions that are each only located at intervals, which are separated from each other in an axial direction of the twisted wire, along an axial length of the twisted wire, wherein:

the twisted wire has a specific cross-section obtained by cutting along a plane orthogonal to the axial direction of the twisted wire, and the plurality of outer peripheral elemental wires in the specific cross-section include:

an outer peripheral elemental wire of the plurality of outer peripheral elemental wires that is bonded to the at least one central elemental wire by the metallically bonded portion of the plurality of metallically bonded portions, and an outer peripheral elemental wire of the plurality of outer peripheral elemental wires that is not metallically bonded to the at least one central elemental wire.

* * * * *